US005197500A

United States Patent [19]

Diamond

[11] Patent Number: 5,197,500

[45] Date of Patent: Mar. 30, 1993

[54] COMBUSTION CHAMBER CLEANING MACHINE

[75] Inventor: Edward M. Diamond, Ellenwood, Ga.

[73] Assignee: Northwest Airlines, Inc., Eagan, Minn.

[21] Appl. No.: 596,202

[22] Filed: Oct. 11, 1990

[51] Int. Cl.[5] ..... B08B 3/02

[52] U.S. Cl. ..... 134/142; 134/200; 134/153; 134/152; 74/578; 74/128; 74/822

[58] Field of Search ..... 134/142, 200, 148, 152, 134/153, 158; 74/578, 128, 822

[56] References Cited

U.S. PATENT DOCUMENTS

| | | | |
|---|---|---|---|
| 932,193 | 8/1909 | Utard | 134/142 |
| 955,471 | 4/1910 | Motz . | |
| 2,719,387 | 10/1955 | Fahrney . | |
| 2,725,063 | 11/1955 | Huffman . | |
| 2,725,685 | 12/1955 | Hill . | |
| 3,043,157 | 7/1962 | Wollar | 74/578 X |
| 3,096,774 | 7/1963 | Alexander | 134/62 |
| 3,153,419 | 10/1964 | Evans et al. | 134/142 X |
| 3,186,246 | 6/1965 | Slinker | 74/128 |
| 3,240,216 | 3/1966 | Sadwith | 134/142 X |
| 3,357,396 | 12/1967 | Melind . | |
| 3,691,691 | 9/1972 | Smith . | |
| 4,084,357 | 4/1978 | Moses . | |
| 4,174,722 | 11/1979 | Fleenor et al. | 134/142 X |
| 4,336,727 | 6/1982 | Junkers | 74/128 |
| 4,577,441 | 3/1986 | Brenner . | |
| 4,662,125 | 5/1987 | Brenner et al. . | |
| 4,753,051 | 6/1988 | Tano et al. . | |
| 5,029,595 | 7/1991 | Hautau | 134/142 |

*Primary Examiner*—Frankie L. Stinson
*Attorney, Agent, or Firm*—Dorsey & Whitney

[57] ABSTRACT

A combustion cleaning machine for removing coatings on the interior of combustion chambers for jet engines is provided and includes a rotatable turntable for carrying a plurality of the generally cylindrical combustors to and from at least one work station where a fluid, liquid or mixture is projected at a combustor under high pressure to remove the interior coating.

The machine includes a revolvable main turntable or wheel having a plurality of individual minor turntables for supporting the combustor cylinders and rotating them. A computer or microprocessing control means is provided for monitoring and controlling various machine functions including the means for indexing the main turntable, the means for rotating the individual turntables and the combustors mounted thereunder, and the means for directing or spraying the material at the cylinders.

10 Claims, 10 Drawing Sheets

B
350
ANYMORE CANS TO BE CLEANED
NO
ALL OF 1220
355
C
YES
RETRACT MOTORS AND PIVOTING CYLINDER 990-120
360
NOT IN POSITION
CHECK POSITION OF MOTORS AND PIVOTING CYLINDER 1030-1040
365
IN POSITION
RELEASE PIVOTING CYL. (INDEXING) 1050-1080
370
NOT LOCKED IN
CHECK POSITION OF PIVOTING CYL. 1090-1100
375
LOCKED IN
COUPLE MOTORS 1110-1140
380
NOT COUPLED
CHECK FOR MOTORS COUPLED 1150-1170
385
COUPLED
NEXT CHAMBER
D
NEXT CHAMBER 1210
390
NONE
C

COMBUSTION CHAMBER CLEANING MACHINE

The present invention relates to carousel or turret-type indexing machines for supporting workpieces and moving them to and from work stations. In particular, it relates to a cleaning machine that rotatably supports a plurality of jet engine combustion chambers or combustors and indexes the combustors successively to and from a work station for treatment of the interior of the combustors.

BACKGROUND OF THE INVENTION

Workpiece handling machines including rotating turrets, carousels or turntables for carrying workpieces to and from one or more work stations where various operations may be performed on the workpieces are well known. These machines are particularly useful when a large number of objects need similar treatment because they allow the positioning of a plurality of workpieces at a work station sequentially and repetitively without substantial manual labor.

U.S. Pat. No. 3,357,396 disclosed a turret-type indexing machine for coating the interior of a can. The machine includes an opposed pair of turret members and two pairs of nozzles. A motor driven chain and helical gear and cam assembly operates both the nozzles and turrets; the cams are designed to provide dwell periods whereby the turrets remain stationary while spraying operations are performed on the cans. Chain driven rotatable disk members contact the sides of the can to rotate them while spraying operations are being performed.

U.S. Pat. No. 2,719,387 discloses a blasting apparatus for abrading the internal surfaces of open-ended, hollow workpieces. A ratchet drive assembly, including a notched ratchet gear wheel, two latching pawls and an advancing pawl, drives and locks a circular table so that a workpiece, held by a work holder, may be treated by a stream of blastant material.

Other patents disclosing machines for sand blasting, cleaning or coating that include turntables or carousels for moving a workpiece from work station to work station include U.S. Pat. Nos. 4,753,051, 4,084,357, 3,240,216, 2,725,685 and 2,725,063. The machines disclosed in these patents representatively include intermittent direct drive (patent '216), cam/stop arrangements (patent '685), or electromagnetic mechanisms (patent '063) for indexing and locking workpieces between or at work stations.

One of the problems with rotatable turntable or carousel type indexing machines is that once the turntable and workpiece supported thereby is properly positioned, there has to be a method or means provided to lock the turntable into position so that work may be carried out. As evidenced by the above prior art, a plurality of pawls (patent '386) or cams that provide dwell periods (patent '397) have been used to accomplish this locking.

Another problem with the rotating turntable type machine is that controlling the various machine operations typically requires a trained operator or a plurality of mechanical or electro-mechanical control devices. A trained operator obviously generates significant expenses and the mechanical or electro-mechanical type control devices require substantial maintenance because of normal wear and the generally hostile environment of use.

A substantially computer-controlled, indexing-type cleaning machine adapted for moving a plurality of combustion chambers to and from a work station without requiring multiple, complicated locking or mechanical control features would be a decided improvement over the indexing or turret-type machines disclosed in the prior art.

SUMMARY OF THE INVENTION

A combustion cleaning machine for removing the coatings sprayed on the interior lining of combustion chambers for jet engines is provided and includes a rotatable turntable for carrying a plurality of the generally cylindrical combustors to and from at least one work station where a concentrated fluid, liquid or mixture stream is directed at a combustor under high pressure to remove the interior coating.

The machine includes a rotatable main carousel or turntable having a plurality of individual turntables for supporting the combustor cylinders and rotating them. A computer or microprocessing control means is provided for controlling various machine functions including the means for indexing the main turntable or wheel, the means for rotating the individual turntables and the combustors mounted thereon, and the means for directing or spraying material onto or at the cylinders.

It is an object of the present invention to provide a cleaning machine for treating jet engine combustors wherein a selected plurality of the combustors may be loaded into the machine and automatically moved to and from a treatment station.

Another object of the present invention is to provide a machine that is simple, self-contained, and enclosed for safety and noise reduction.

Still another object is to provide a simp.e, substantially computer-controlled cleaning machine for cleaning jet engine combustion chambers that includes a rotating carrier for supporting a plurality of the chambers whereby the chambers may be accurately, successively and securely indexed to at least one work station and securely locked there while work operations are carried out.

One the major advantages of the present invention is that it enables the safe, efficient treatment of the interior linings of jet engine combustion chambers. Additionally, the machine may be easily controlled for multiple spraying passes and multiple, repetitive, successive rotation of the workpieces to and from a work station.

DETAILED DESCRIPTION OF THE PREFERRED EMBODIMENT

Figure 1:
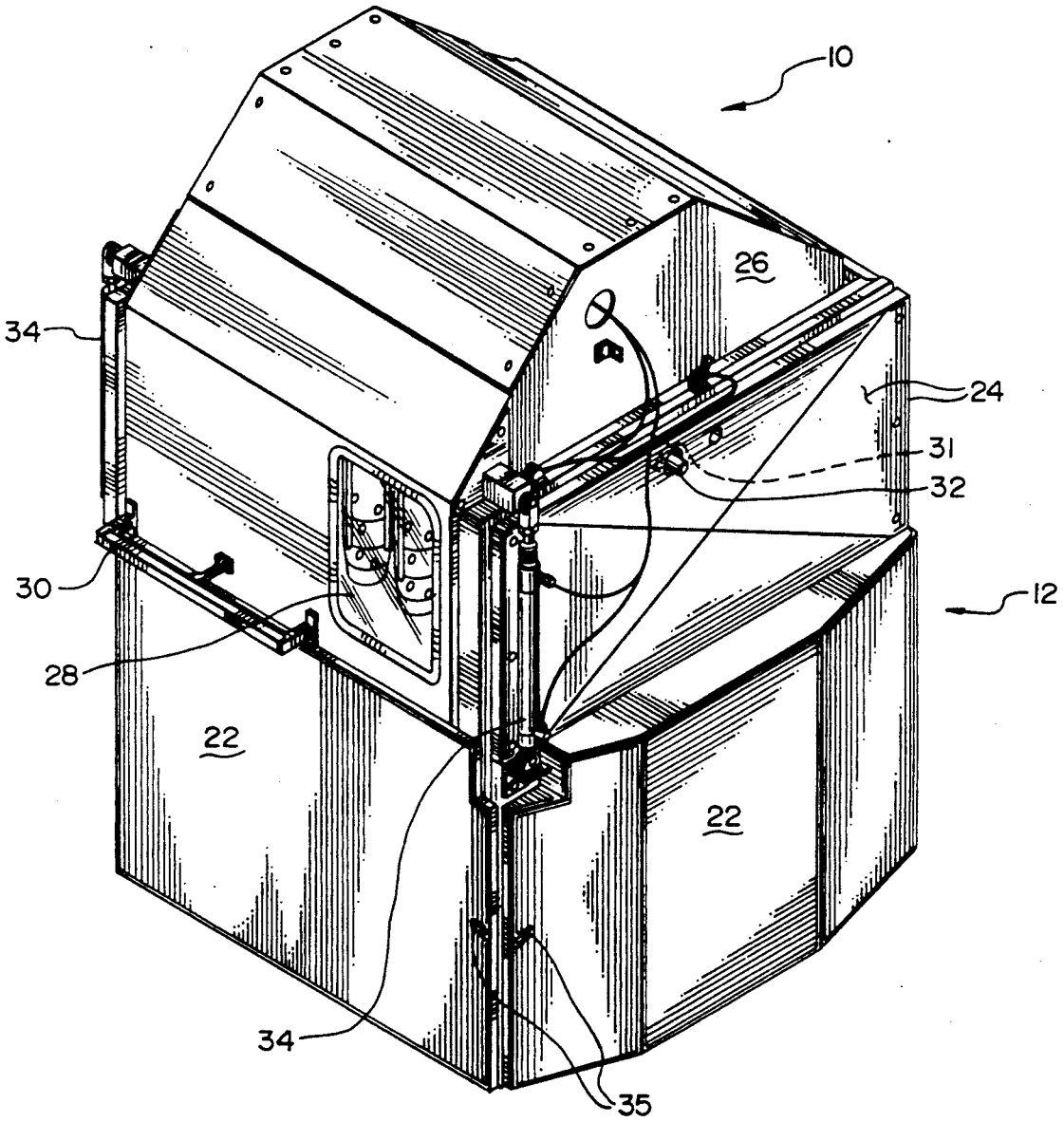
FIG. 1 is a perspective view of the machine of the present invention.
Figure 2:
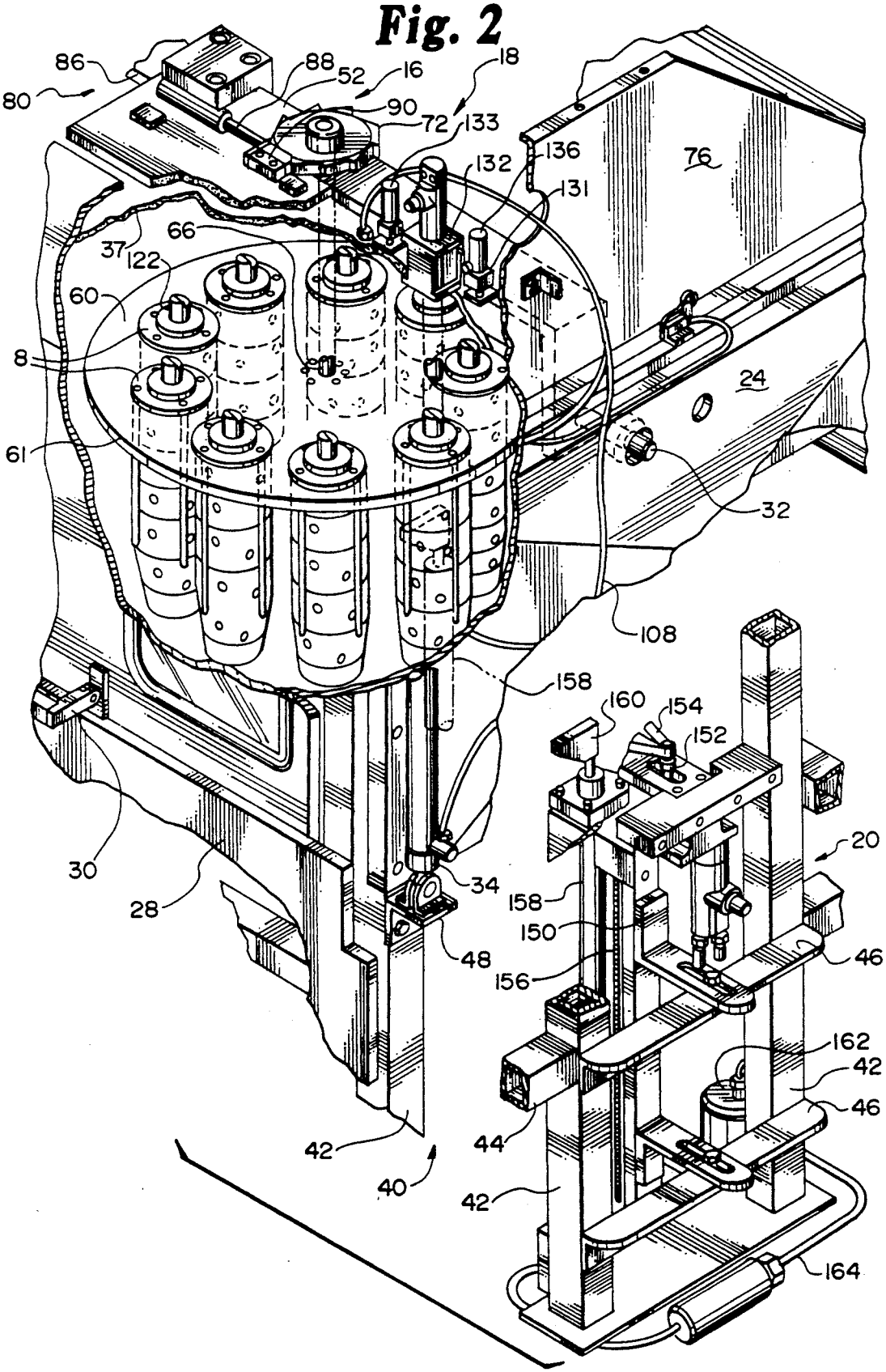
FIG. 2 is a perspective view of the machine with paths thereof cut away, simplified or relocated for clarity.

The combustion chamber cleaning machine 10 in accordance with the present invention is depicted in FIGS. 1 and 2. The machine 10 includes a cabinet 12, an indexing assembly 14 including a main wheel drive 16 and a minor disk drive 18, and a projection assembly 20.

As further depicted in FIGS. 1 and 2, the cabinet 12 generally encloses the machine 10 and includes four bottom panels 22, three top panels 24 and a top lift panel 26. The top lift panel is provided with a viewing window 28 and a handle 30. The top lift panel 26 is suspended on and pivots by lateral bearing mounts 31 supporting a door shaft 32. A pair of pneumatic lift and close assisting cylinders 34 are provided at either side of the top lift panel 26. When a force is exerted on the handle 30, a solenoid (not shown) is engaged and air pressure flows to the cylinders 34 to raise or lower the top lift panel or door 26.

The remaining bottom and top panels 22, 24 may be removably mounted and may be held in place by latches 35. Also, all the panels may be hollow core panels, the core being filled with various suitable insulating materials 37 for deadening sound.

Figure 5:
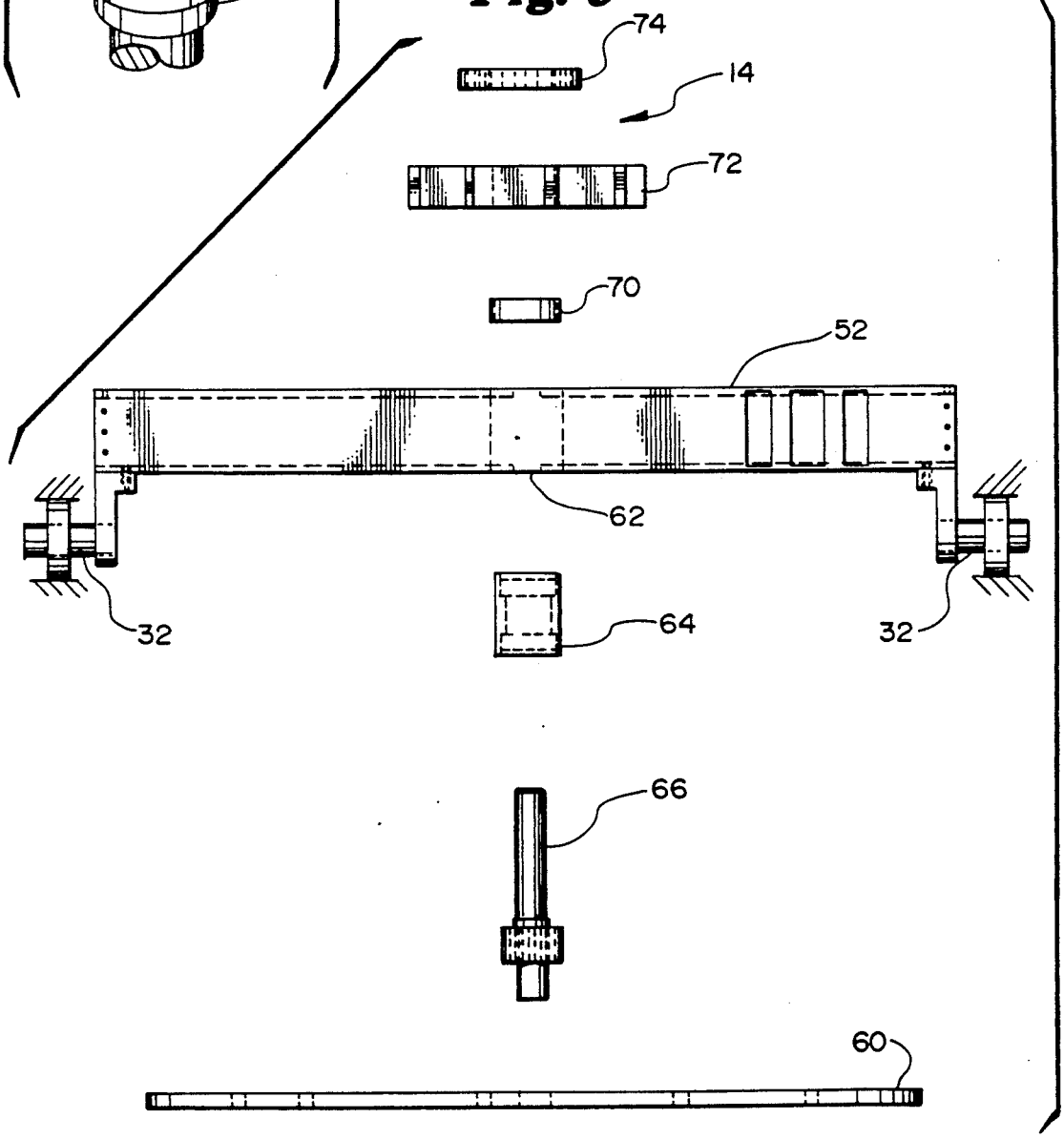
FIG. 5 is a simplified, exploded view depicting the main turntable mounting assembly of the present invention.
Figure 8:
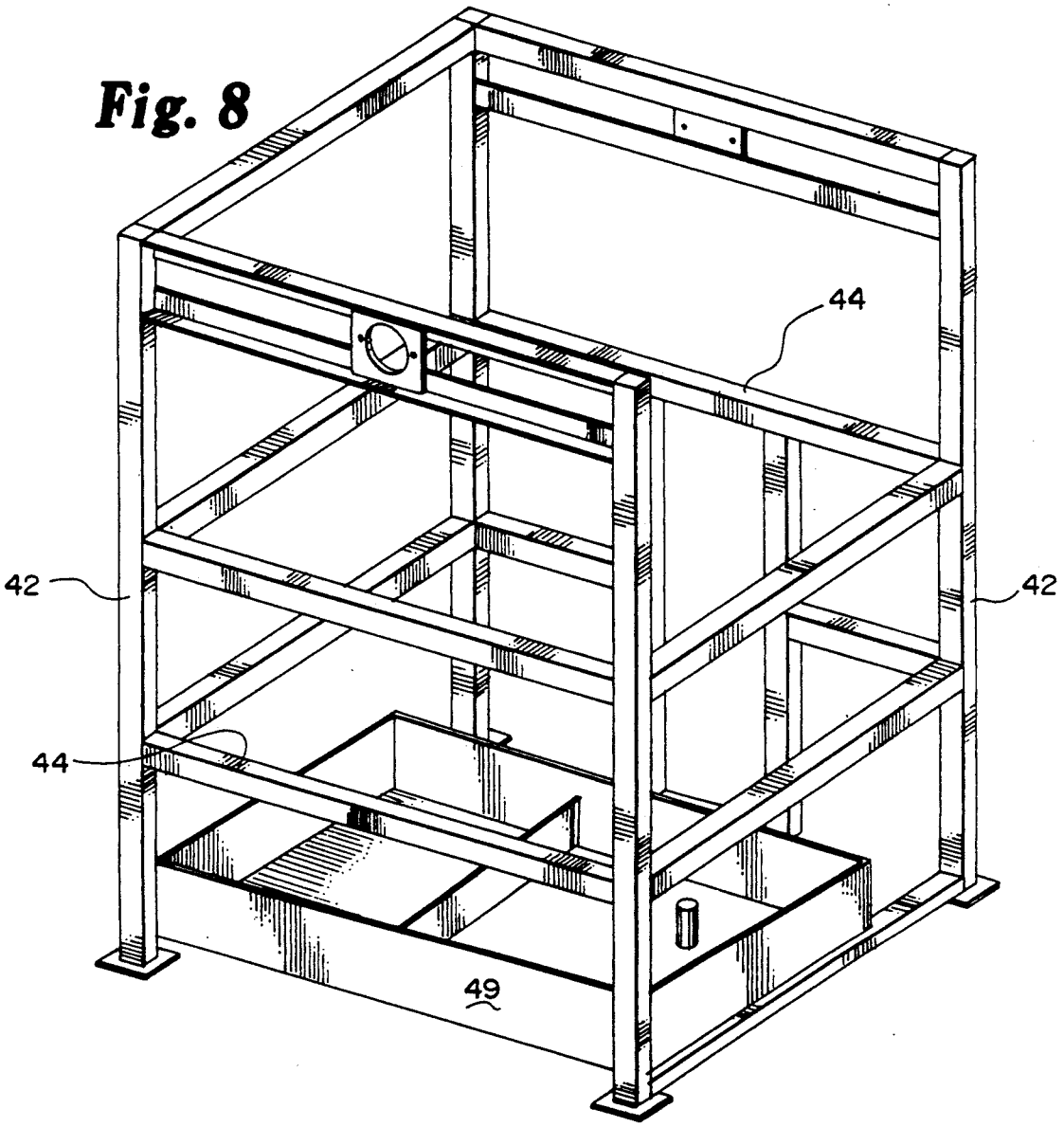
FIG. 8 is a perspective view of the support frame of the present invention.

The cabinet 12 includes a support frame 40 comprises of a plurality of vertical columns 42 and horizontal beams 44. Additional members such as cross braces and other struts may be provided as required, but the frame 40 includes guide brackets 46 (FIG. 2) for supporting the spraying assembly 20. Additional guides or mounts exemplified by cylinder mount 48 may be provided as required. FIG. 8 depicts that the frame 40 may support a sump pan 49 for containing a liquid to be recycled. The frame 40 includes an upper, central, hollow crossbeam 52. FIG. 5 depicts the central crossbeam and its relation to the door shaft 32 and to the indexing assembly 14.

The indexing assembly 14 of the present invention broadly includes two major subcomponents, a main wheel or turntable drive 16 and a minor disk drive 18.

FIGS. 2 and 5 depict the main wheel 60 and how it is mounted or operably attached to the crossbeam 52. Specifically, the crossbeam 52 includes a generally central aperture 62. A main bearing housing 64 is received in aperture 62, and in turn receives a main shaft 66. The shaft 66 extends through the bearing housing and the main disk or carousel 60 is fixed or connected thereto under the crossbeam 52. Above the crossbeam 52, a main shaft spacer 70 is provided to space an index gear 72 from the crossbeam 52. A main shaft lock nut 74 is threadably received at the upper end of the main shaft 66. The index gear 72 is fixedly mounted on the main shaft 66.

Figure 6:
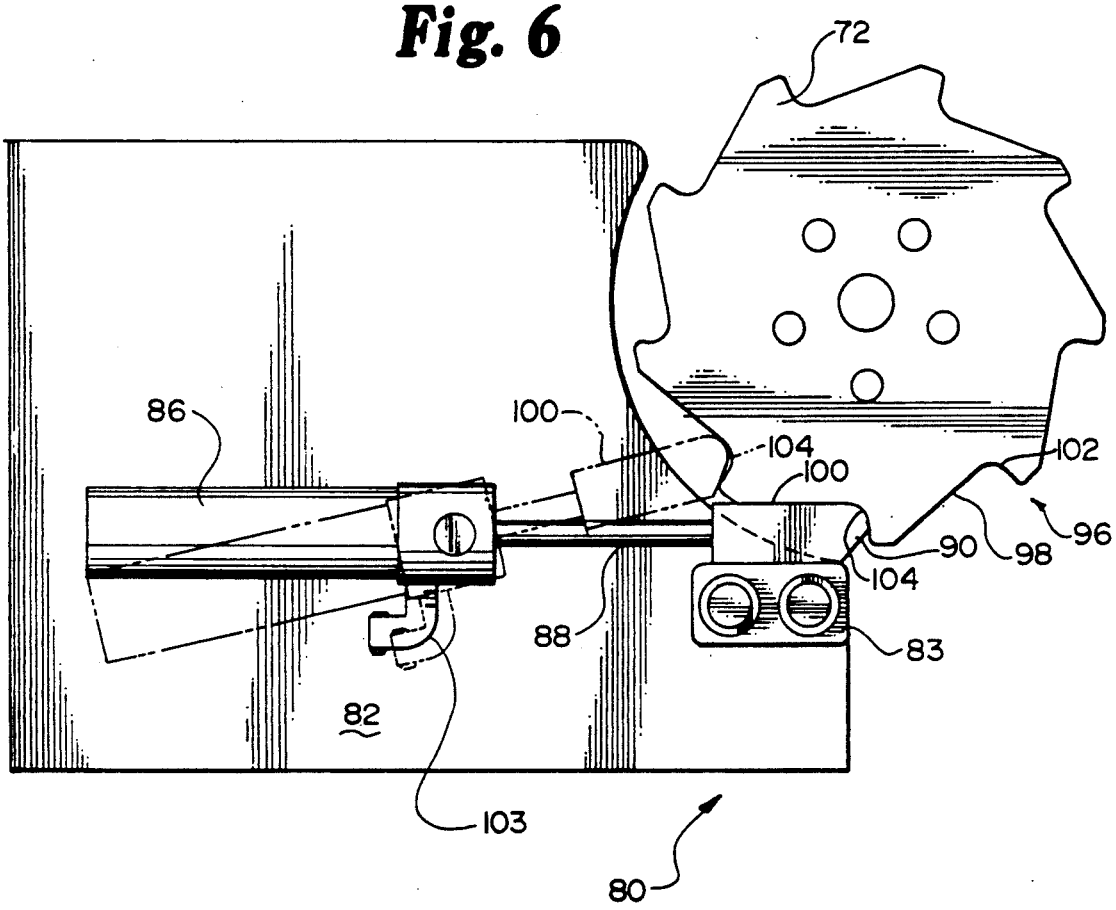
FIG. 6 is a simplified top plan view of the indexing means of the present invention.

FIGS. 2 and 6 depict index operator or mechanism 80. The operator 80 is supported by an indexer base plate 82 mounted on the upper side of the crossbeam 52. A pneumatic cylinder and ram arrangement, comprising a cylinder 86 and a ram 88, is pivotally attached to the base plate 82, along with a stop block 83. An index pusher tip 90 is connected to the end of the ram 88.

FIG. 6 depicts that the index pusher tip 90 is specially configured to compliment and cooperate with the indexing gear 72. The lobs 96 of the gear 72 include a relatively long planar or flat surface 98. The index pusher 90 has a complimentary flat surface 100. Additionally, the bottom 102 of the tooth or lobe 96 of the gear 72 an the end 104 of the index pusher 90 are complimentary. The purpose of the complimentary flat surfaces 98, 100 and the pusher end and bottom of the tooth 104, 102 will be explained hereinbelow.

FIG. 6 depicts the cylinder ram arrangement of the operator 80 in a second position in phantom. The cylinder ram moves to the second position because it is pivotally attached to the base plate 82 and biased about that pivot point (not shown) by an appropriate spring mechanism. The pressurized air fitting 103 depicted in FIG. 6 is a conventional fitting and may be connected in a conventional manner to air pressure supply lines 108 (FIG. 2).

Further reference to FIG. 2 indicates that the main wheel or turntable 60 supports a plurality of minor disks or turntables 18. The minor disks 18 are located generally around the peripheral edge 61 of the main wheel 60, and are mounted for revolving or rotational motion with respect to the wheel 60. As depicted in FIG. 2, the number of minor disks or turntables 18 corresponds to the number of lobes 96 on the index gear 72. However, a lesser or greater number of minor turntables 18 may be provided.

Figure 3:
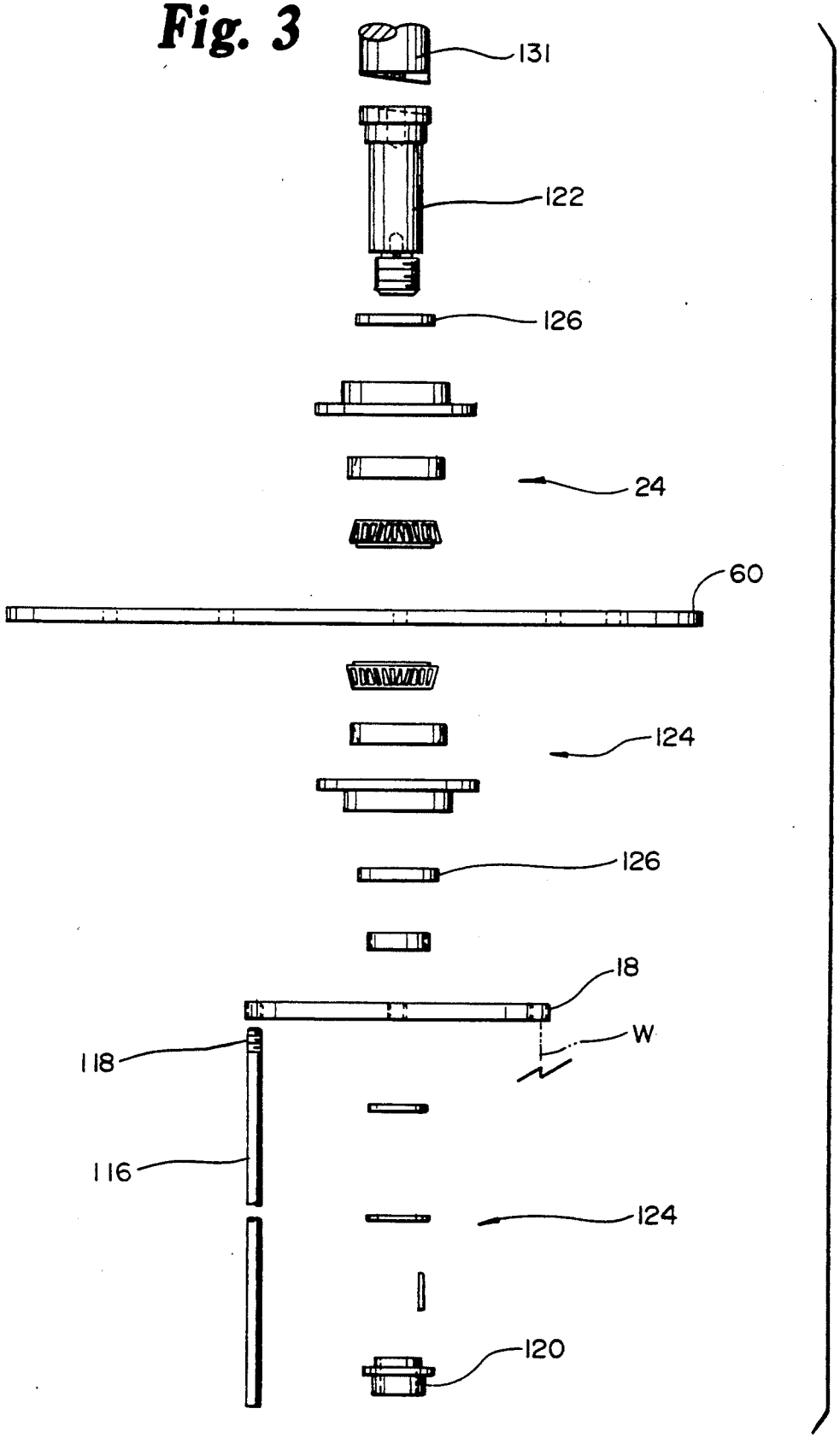
FIG. 3 is a simplified, exploded view of a portion of the present invention, specifically the combustion chamber mounting assembly.

FIGS. 2 and 3 depict the operative mounting or connection between the minor turntables 18 and the main wheel 60, as well as depicting how the combustor cylinders or workpieces W are supported or attached to the minor disks 18. Specifically, the combustors W depend from the minor disks 18 and are guided into proper alignment therewith by a plurality of shaft-like combustor holders 116. The combustor holders 116 may be attached directly to the minor disks at threaded end 118.

The combustors W are held in place against the minor disks 18 by combustor nut or holder 120. The holder 120 is threaded at the inner diameter thereof and is attached to one of a plurality of motor coupler spindles 122. The number of coupler spindles 122 corresponds to the number of lobes of the indexing gear 72, but a greater or lesser number may be provided. Between the holder 120 and a spindle 122, as depicted in FIG. 3, the minor disk 18 abuts the upper end of the combustor W. Together, the combustor W and the minor disk 18 are rotatably positioned relative to the main wheel 60 by a plurality of bearing members 124. The bearing members 124 may comprise typical, commercially available washers, spacers and bearings and races, but specifically designed upper and lower dust seals 126 may be required.

Figure 4:
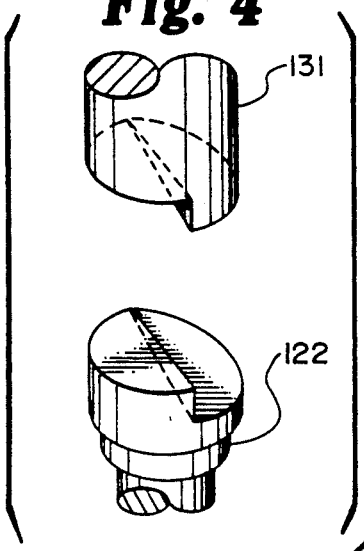
FIG. 4 is a fragmentary perspective view of the assembly depicted in FIG. 3, specifically the spindle coupling thereof.
Figure 7:
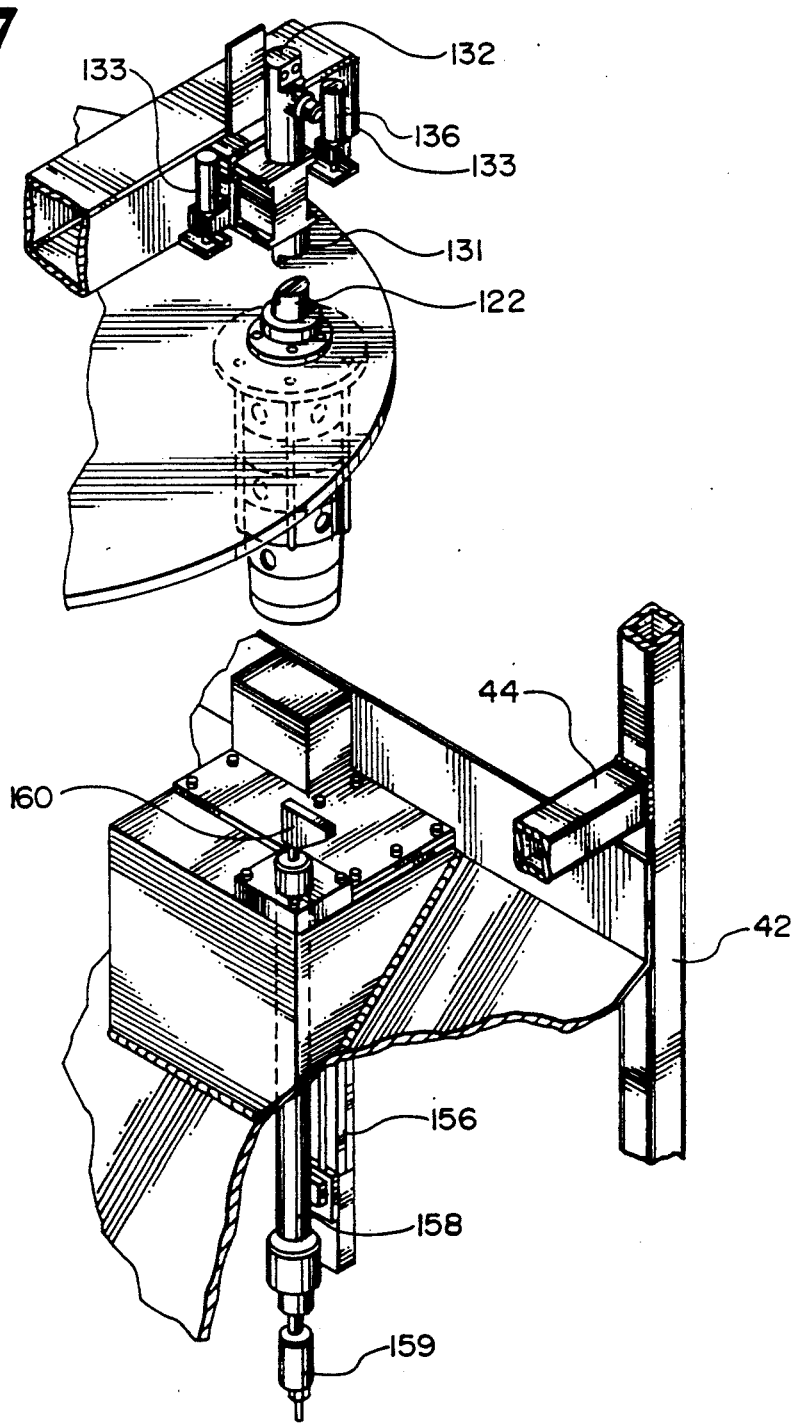
FIG. 7 is a fragmentary perspective view of a portion of the spray assembly and the combustor rotating drive assembly of the present invention.

As depicted in FIG. 2, the upper end of each coupler spindle 122 stands generally vertically and upwardly away from the upper surface of the main wheel. The upper end of a spindle 122 is adapted for interlocking engagement with the shaft 131 of the minor disk drive motor 132. An exemplary machining to effect the engagement between the coupler spindle shaft 122 and the motor drive shaft 131 is depicted in FIGS. 4 and 7.

The motor drive shaft 131 is operatively connected with a pneumatic disk drive motor 132. The interengagement between the spindle shaft 122 and the motor drive shaft 131 may be caused by a spring (not shown)

in cylinder 133 that moves the shaft 131 downward so that engagement with coupler spindle shaft 122 is achieved. The coupler motor 132 may be connected to a pressurized air source by conventional means including air pressure fittings 136.

The spraying assembly 20 for directing material under pressure against the workpieces W is stationarily mounted to the support brackets 46 at one or the other side of the machine 10. The assembly 20 includes a drive motor 150 operatively connected by a shaft 152 to a drive belt 154. The drive belt 154 is connected to a linear slide 156 and a spray arm 158 is mounted on the slide 156. The arm 158 includes a nozzle 160 at the end thereof. It is not beyond the scope of the present invention that a plurality of nozzles be provided along the length of the spray arm 158 or that the nozzle 160 be rotatably coupled to the arm 158. FIG. 7 depicts a configuration for nozzle 160 and that swivel 159 may be provided whereby the nozzle 160 may be rotated.

A high pressure water supply is controlled by solenoid 162 connected to a water line 164. The travel of the spray arm 158 and the linear slide 156 may be controlled by a remote computer or, more conventionally, by commercially available contact or limit switches at the upper and lower limits of the linear slide 156 travel.

Figure 9A:
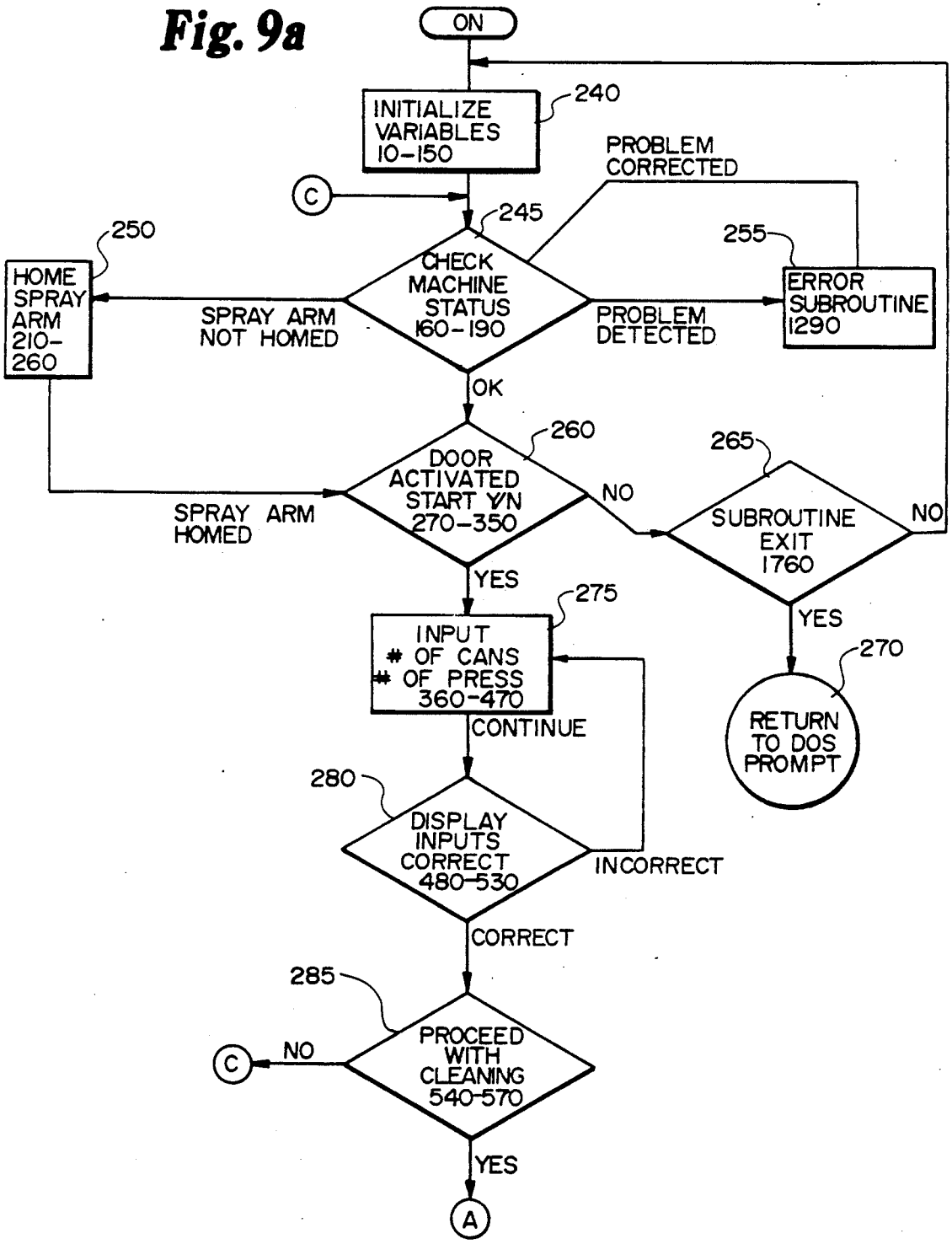
FIGS. 9*a*, 9*b* and 9*c* are interrelated portions of a detailed flow chart for implementing the data processing methodology for controlling and operating the machine of the present invention.
Figure 9B:
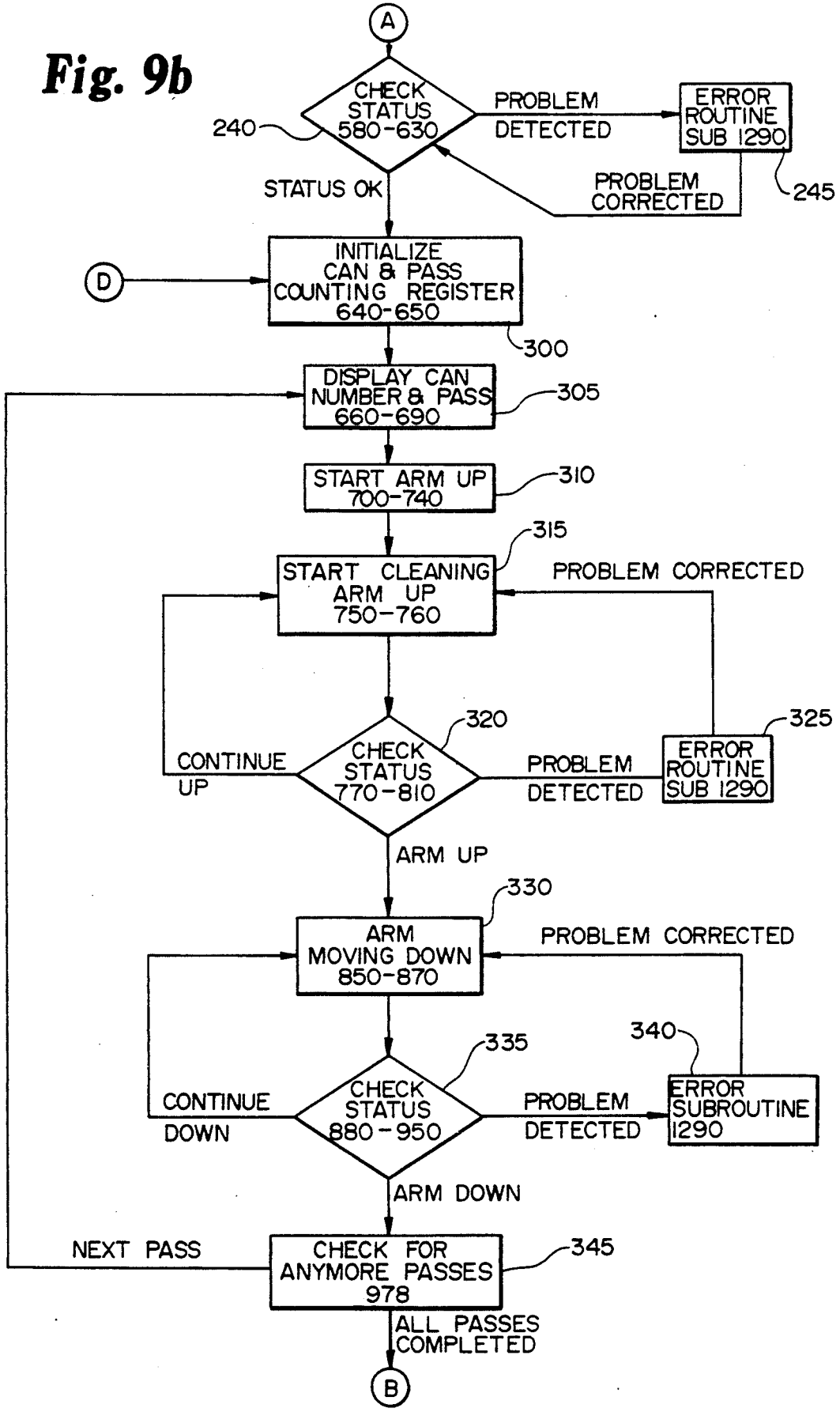
Figure 9C:
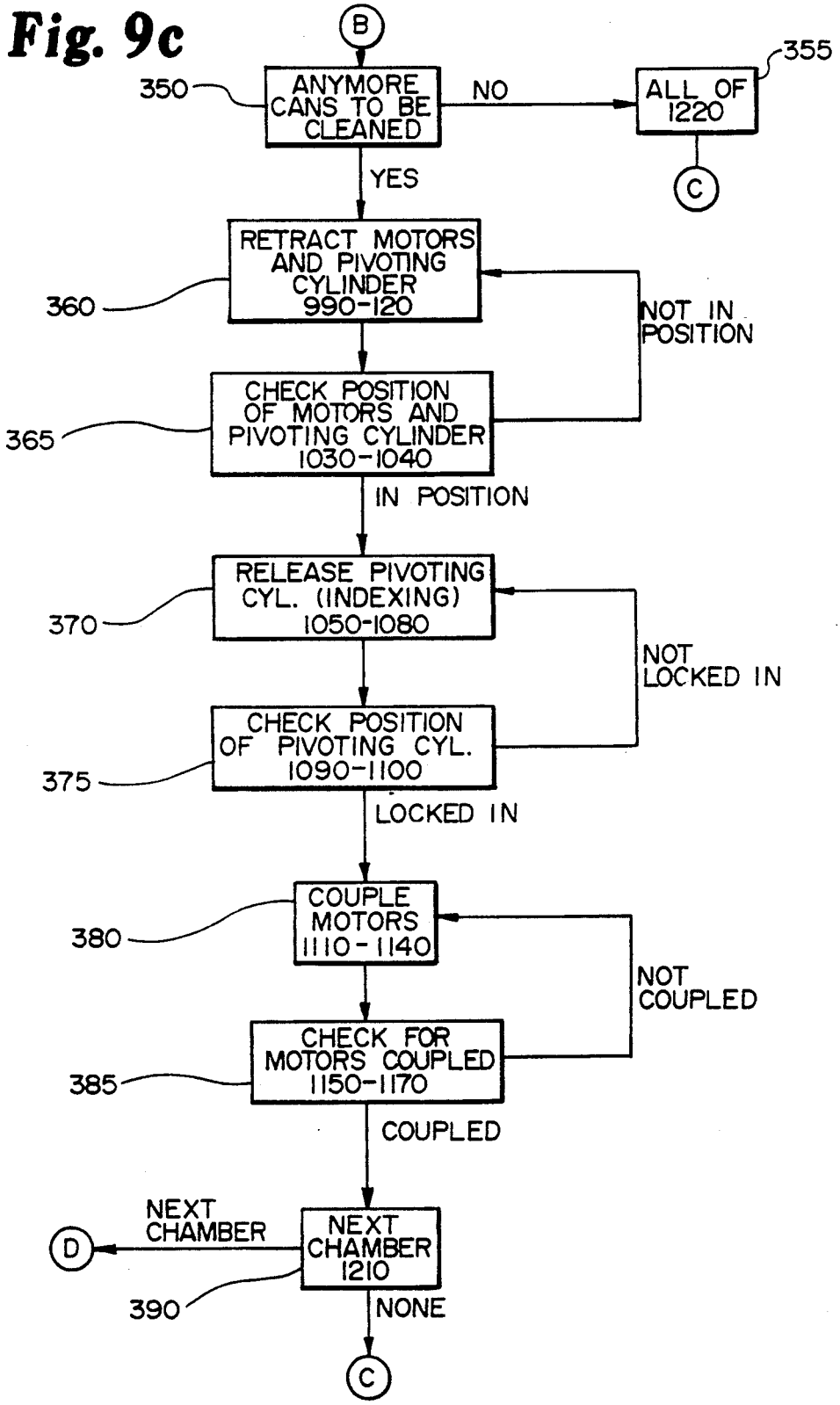

FIGS. 9*a*, 9*b*, and 9*c* comprise a detailed flow chart of the software used to control and monitor the operation of the cleaning machine 10. A program listing, written in BASIC for executing the software on an IBM compatible XT with an Opto 22 control and relay board, or compatible microprocessor or computer, is included at the end of this specification. The computer is at a remote location and therefore not depicted, but may be incorporated with the machine 10.

Function 240 initializes variables and constants used throughout processing as indicated in lines 10 to 150 of the program listing. Function 245 checks the machine status and directs the program to either block 50 to home the sprayer assembly 20 or into error subroutine loop, function 255. Function 260 indicates activity of the lift panel 26 and the start or no start decision. A no start decision directs the program to subroutine exit function 256 and from there, to either function 270, awaiting operator input, or back to the ready state preceding the initialization of the variables, function 240.

The next part of the program is designed to control the machine operation by putting in and checking the data of operational perameters. Specifically, function 275 requests information about the number of rotations of the main wheel 60, as well as the number of combustors W secured in place on the minor disks 18. Function 280 displays the input data for correction if necessary. Function 285 is a decision block requiring input as to whether or not to proceed with the operation; a no answer sends the program back to just prior to function 245, the status block. A yes input at function 285 directs the program to function 290 to see if all portions of the machine are free of error or problems. Again referencing line 1290 of the program, an error subroutine loop is provided at function 295. Once it has been determined that the status is alright, function 300 initializes the combustor pass counting register which is displayed at function 305. The display of the input information is provided at function 305.

The program next proceeds to the start arm function 310 and start cleaning function 315 wherein the arm is directed to move. Another status function is provided at 320, and an error routine, program line 1290, is provided again at function 325. The arm is monitored through function 330, status check function 335 and another error subroutine block 340.

Processing is next directed to function 345 to determine if any more passes have been input by the operator. If all passes have been completed, the program is directed to function 350 addressesing whether any more combustors W are to be cleaned. If not, the flow is directed to an "all off" state, function 355. If more passes are required at function check 345, the program is redirected to block function 305 and returned through the just recited sequence.

The program continues at block 360 if a positive response is received at function 350. Function 365 is directed to checking and correcting the position of the drive motors and, specifically, the motor 132 that rotates the minor disks 18. Function 370 and 375 monitor and operate the indexer 80 and check to make sure that the indexer 80 is properly locked between the stop block 94 and the indexing gear 72.

Processing is then directed to functions 380 and 385 to make the interlocking connection between the spindle 122 and the motor drive shaft 134. Function 385 checks to make sure that proper interconnection has been made.

Function 390 directs a continuation of indexing so that the next combustor W may be cleaned or another pass of the previously treated combustors W may be made. Function 390 may also send the program to the "all off" state or to a machine status check function 245. These program directions are made before activating the lift panel 26 to load an additional or second set of combustors W for treatment.

In use, the machine 10 is a closed cabinet operation. When the machine 10 is first turned on, the program described above checks the status of the various inputs or limits for machine 10. If the machine 10 is ready, the operator is prompted to continue. If not ready, an error code is given so that the operator can quickly and efficiently correct the indicated problem. The machine 10 also homes the spray assembly 20 at this point of the program.

The operator loads the machine by opening the top lift panel 26 which pivots up and back or pivots supported in bearing mounts 31 via computer control at function 260. To be opened, the top lift panel 26 must be activated at function block 262 by exerting pressure on the handle 30; a solenoid is engaged allowing air under pressure to flow to lift cylinders 34. The top lift panel 26 will be raised up and back, exposing the underside of the main wheel 60 and the minor disks 18. The operator has easy access to the combustor holding disks 18 and may easily attach the combustors W thereto using the assembly depicted in FIG. 3. After loading the machine 10, the operator closes the top lift panel 26 by applying downward pressure on the handle which again engages the solenoid. The door lowers until it makes a limit switch; the computer which then prompts the operator to continue at function block 260.

The number of combustors W to be cleaned and the number of rotational passes that the main wheel 60 is to make with the spray assembly 20 operational is then input. The program asks for verification before prompting the operator to continue, function block 280 in FIG. 11*a*. If the operator inputs only a quantity of combustors W to clean and no passes, the machine 10 will index the amount of combustors W that were selected.

The general, broadly state purpose for the main wheel 60 and the indexer operator 80 is to move the next combustor W sequentially over the spray assembly 20 and then hold or lock the main wheel or turntable 60 in that position until the programmed cleaning passes are completed. Indexing is accomplished by using the nine lobe indexing gear 72 directly connected to the main wheel 60 and the pneumatic operator 80. The air cylinder 86 is normally pressurized at a fully extended position as depicted in FIG. 6 and limit switches may be provided to indicate that state. For indexing, the ram is retracted by removing air pressure from the cylinder; the ram 88 retracts, and the operator 80 is spring biased into the position depicted in phantom in FIG. 6. When the cylinder is repressurized, the ram 88 extends into the space between the teeth on gear 72, moving the gear 72 rotationally in the direction of extension. When the indexer operator 80 is fully extended, the main wheel 60 will be locked precisely in placed because of the cooperating relatively long flat surfaces of the gear 72 and the index pusher 90, surfaces 98, 100 respectively.

Once the machine 10 has indexed and locked, the drive motor 132 is coupled into the spindle coupler shafts 122 depicted in FIGS. 3 and 4. This is accomplished by removing the air pressure from the motor cylinders 133. Again, spring force created by internal springs (not shown) in the cylinders 133, pushes the shafts 131 downward until they are coupled with the coupler 122.

As the cleaning operation begins, the motor 132 is activated, rotating the minor disk 18 and the combustor W suspended thereunder. The slide assembly motor 150 is activated to turn a lead screw in the linear slide 156. This moves the spray arm 158 and nozzle assembly 160 upwardly into the combustor W. High pressure water is then turned on by the solenoid 162; water pressures may be provided in the range of 10,000 to 50,000 psi. The spray arm 158 continues moving upward until computer control directs it to move downwardly or, alternatively, until a contact or limit switch is reached. Then it returns downwardly until it makes a lower switch or until the computer program directs that it should stop or travel upwardly again. Additional passes, upward or downward movements of the spraying assembly 20 while water under pressure is projected from nozzles 160 are selected in the beginning of the program at function 275. The operation of the machine 10 and the interior of the cabinet 12 may be observed through a window 28.

Computer control provides a high degree of programming flexibility because the operator has the option of selecting how many combustors W to clean and how many cleaning passes will be made. Once the machine 10 is loaded it will proceed to run according to the outlined program until either the program is completed or the operator sees a need to terminate the operation.

It should be understood that while the preferred embodiment of the present invention is illustrated and described herein as a machine 10 for spraying the insides of jet engine combustion cylinders, the invention is not limited to the spraying of such combustors and may be used in various other situations for indexing any workpiece to a work station so that an operation is performed on the workpiece.

The various parts and components of the machine 10 may be formed from any appropriate material. The machine 10 may be adapted to direct or spray any liquid, liquid/fluid combination, liquid/abrasive combination or abrasive, and to filter and recycle the selected material. Operating displays and indicia may be provided on the cabinet 12 or at a remote location.

Although the description of the preferred embodiment has been presented, it is contemplated that various changes, including those mentioned above, could be made without deviating from the spirit of the present invention. It is therefore desired that the present embodiment be considered in all respects as illustrative, not restrictive, and that reference be made to the appended claims rather than to the foregoing description to indicate the scope of the invention.

```
10 CLS:KEY OFF
20 BASE% = &H220
30 OUT BASE% + 1,0
40 OUT BASE% + 3,0
50 OUT BASE% + 5,0
60 OUT BASE% + 0,&HFF
70 OUT BASE% + 2,&HF
80 OUT BASE% + 4,&H0
90 OUT BASE% + 1,&H34
100 OUT BASE% + 3,&H34
110 OUT BASE% + 5,&H34
120 OUT BASE% + 0,&HFF
130 OUT BASE% + 2,&HF
140 OUT BASE% + 0,255:OUT BASE% + 2,255:REM ALL OFF
150 CLS
160 FOR T=1 TO 200
170 A=INP(BASE% +4):IF A = 217 OR A = 153 THEN 210
180 IF A=89 THEN 270
190 NEXT T
200 GOSUB 1290:GOTO 160
210 CLS:PRINT:PRINT:PRINT:PRINT:PRINT:PRINT:PRINT:PRINT:PRINT
220 PRINT "                                    SPRAY ARM IS MOVING HOME"
230 OUT BASE% + 2,14:REM SPRAY ARM MOTOR (ON DOWN)
240 A=INP(BASE% + 4):IF A = 89 THEN 270
250 IF A=217 THEN 240
260 GOTO 240
270 OUT BASE% + 0,254:OUT BASE% + 2,255:REM TURNS AIR ON TO DOOR
280 CLS:PRINT:PRINT:PRINT:PRINT:PRINT:PRINT:PRINT:PRINT:PRINT
290 PRINT "                                    NORTHWEST AIRLINES"
300 PRINT "                                WATER BLAST CLEANING OPERATION"
310 PRINT "                                     JT8D BURNER CANS"
```

```
320 PRINT:PRINT:PRINT:PRINT:PRINT:
330 PRINT "                                        START"
340 GOSUB 1630:IF R$ = "Y" THEN 360
350 IF R$ = "N" THEN 1720
360 CLS:PRINT:PRINT:PRINT:PRINT:PRINT:PRINT:PRINT:PRINT:PRINT:PRINT:PRINT
370 PRINT "                        ENTER NUMBER OF CANS TO BE CLEANED"
380 PRINT:PRINT"                              OR PRESS (N) TO RESTART"
390 A$=INKEY$:B=VAL(A$):IF VAL(A$)>0 THEN 420
400 IF A$="N" OR A$="n" THEN 150
410 GOTO 390
420 CLS:PRINT:PRINT:PRINT:PRINT:PRINT:PRINT:PRINT:PRINT:PRINT:PRINT
430 PRINT "                      ENTER NUMBER OF CLEANING PASSES PER CAN"
440 PRINT:PRINT"                              OR PRESS (N) TO RESTART"
450 B$=INKEY$:C=VAL(B$):IF VAL(B$)>0 THEN 480
460 IF A$="N" OR A$="n" THEN 150
470 GOTO 450
480 CLS:PRINT:PRINT:PRINT:PRINT:PRINT:PRINT:PRINT:PRINT:PRINT:PRINT
490 PRINT "                      YOU HAVE SELECTED":B"CANS AND";C"PASSES PER CAN
500 PRINT:PRINT "                             IS THE ABOVE INFORMATION CORRECT"
510 GOSUB 1630:IF R$ = "Y" THEN 540
520 IF R$="N" THEN 360
530 GOTO 480
540 CLS:PRINT:PRINT:PRINT:PRINT:PRINT:PRINT:PRINT:PRINT:PRINT
550 PRINT "************  WOULD YOU LIKE TO PROCEED WITH THE CLEANING OPERATION
**********"
560 GOSUB 1630:IF R$ = "Y" THEN 580
570 IF R$="N" THEN 150
580 OUT BASE% + 0.255:OUT BASE% + 2.255:REM TURNS AIR OFF TO DOOR (ALL OFF)
590 FOR Q= 1 TO 100
600 A=INP(BASE% +4):IF A = 89 THEN 640
610 A$=INKEY$:IF A$="O" THEN  1760
620 NEXT Q
630 GOSUB 1290:GOTO 580
640 FOR X=1 TO B
650 FOR Y=1 TO C
660 A$=INKEY$:IF A$="O" THEN 1760
670 CLS:PRINT:PRINT:PRINT:PRINT:PRINT:PRINT
                                        SYSTEM  STATUS":PRINT:PRINT:PRINT:PRI
680 PRINT"
690 PRINT "                      CLEANING CAN":X"OF":B" AND ON PASS":Y;"OF":C
700 OUT BASE% + 0.27:OUT BASE% + 2.255
710 FOR P=1 TO 5500
720 A$=INKEY$:IF A$="O" THEN 1760
730 NEXT P
740 PRINT:PRINT:PRINT:PRINT:PRINT "                                  SPRAY HEAD IS MO
NG UP"
750 FOR O=1 TO 200000!
760 OUT BASE% + 0.57:OUT BASE% + 2.255:REM TURNS ON WATER. SPRAYHEAD MOTOR.CAN
OTATOR (SPRAYHEAD GOING UP)
770 A=INP(BASE% + 4):A$=INKEY$:IF A$="O" THEN 1760
780 IF A=153 OR A=25 THEN 850
790 IF A=89 OR A=85 OR A=217 THEN 830
800 A$=INKEY$:IF A$="O" THEN 1760
810 GOSUB 1290:GOTO 740
820 A$=INKEY$:IF A$="O" THEN 1760
830 NEXT O
840 GOSUB 1290
850 PRINT:PRINT:PRINT:PRINT:PRINT "                                  SPRAY HEAD IS MO
NG DOWN"
860 FOR E=1 TO 200000!
870 OUT BASE% + 0.185:OUT BASE% + 2.254:REM TURNS ON SPRAYHEAD MOTOR. CAN ROTA
R (SPRAYHEAD GOING DOWN)
880 A=INP(BASE% +4):A$=INKEY$:IF A$="O" THEN 1760
890 IF A=89 THEN 960
900 IF A=153 OR A=217 THEN 940
910 A$=INKEY$:IF A$="O" THEN 1760
920 GOSUB 1290:GOTO 850
930 A$=INKEY$:IF A$="O" THEN 1760
940 NEXT E
950 GOSUB 1290
960 CLS
970 NEXT Y
980 IF X=B THEN 1220
990 CLS
1000 PRINT:PRINT:PRINT:PRINT:PRINT:PRINT:PRINT "
RT INDEX RETRACT"
```

```
1010 OUT BASE% + 0.231:OUT BASE% + 2.255
1020 REM LINES 990-1220 CONTROL INDEX
1030 A=INP(BASE% + 4):IF A=86 THEN 1050
1040 GOTO 1010
1050 PRINT:PRINT:PRINT "                                    LOOKING FOR INDEX STOP"
1060 OUT BASE% + 0.247:OUT BASE% + 2.255
1070 FOR Z=1 TO 1000
1080 NEXT Z
1090 A=INP(BASE% + 4):IF A=85 THEN 1110
1100 GOTO 1080
1110 CLS
1120 FOR W=1 TO 1000
1130 NEXT W
1140 OUT BASE% + 0.159:OUT BASE% + 2.255
1150 A=INP(BASE% + 4):IF A=89 THEN 1180
1160 IF A=91 THEN GOSUB 1290
1170 GOTO 1140
1180 PRINT:PRINT:PRINT:PRINT:PRINT:PRINT:PRINT:PRINT:PRINT "
        INDEX COMPLETED AND LOCKED"
1190 FOR I=1 TO 1000
1210 NEXT X.
1220 OUT BASE% + 0.255:O   BASE% + 2.255:REM ALL OFF
1230 CLS
1240 GOTO 150
1250 FOR K=1 TO 6000
1260 NEXT K
1270 GOTO 150
1280 END
1290 CLS:PRINT:PRINT:PRINT:PRINT:PRINT:PRINT
1300 FOR V=1 TO 20
1310 A=INP(BASE% +4)
1320 IF A=255 THEN 1430
1330 IF A=105 THEN 1440
1340 IF A=121 THEN 1450
1350 IF A=252 THEN 1480
1360 IF A=251 THEN 1490
1370 IF A=250 THEN 1500
1380 IF A=249 THEN 1510
1390 IF A=94 THEN 1460
1400 IF A=91 THEN 1470
1410 NEXT V
1420 LET N$="UNRECOGNIZED ERROR":GOTO 1530
1430 LET N$="CHECK AIR SUPPLY":GOTO 1530
1440 LET N$="MAIN DOOR IS OPEN":GOTO 1530
1450 LET N$="MAIN DOOR IS BETWEEN LIMIT SWITCHES":GOTO 1530
1460 LET N$="COUPLER STUCK BETWEEN LIMITS":GOTO 1530
1470 LET N$="INDEX EXTEND INCOMPLETE":GOTO 1530
1480 LET N$="CHECK LIMIT SWITCH 3":GOTO 1530
1490 LET N$="CHECK LIMIT SWITCH 4":GOTO 1530
1500 LET N$="CHECK LIMIT SWITCH 5":GOTO 1530
1510 LET N$="CHECK LIMIT SWITCH 6":GOTO 1530
1520 LET N$="CHECK LIMIT SWITCH 7"
1530 PRINT "                                    PROBLEM DETECTED"
1540 OUT BASE% + 0.255:OUT BASE% + 2.255:REM ALL OFF
1550 PRINT "                                    ";A;N$
1560 PRINT "                          SYSTEM HALTED ON CHAMBER";X"OF";B".PASS";Y
1570 PRINT "                                  DO YOU WISH TO CONTINUE"
1580 GOSUB 1630:IF R$="Y" THEN 1810
1590 IF R$="N" THEN 1720
1600 GOTO 1290
1610 CLS
1620 RETURN
1630 PRINT:PRINT "                                          Y OR N"
1640 R$ = INKEY$
1650 IF R$ = "Y" OR R$ = "y" THEN LET R$ = "Y"
1660 IF R$ = "N" OR R$ = "n" THEN LET R$ = "N"
1670 IF R$ = "Y" OR R$ = "N" THEN 1700
1680 IF R$="34 M 1710
1690 GOTO 1640
1700 RETURN
1710 LOAD"DEFAULT".R
1720 CLS:PRINT:PRINT:PRINT:PRINT:PRINT:PRINT:PRINT:PRINT:PRINT:PRINT:PRINT:PR
"                    ARE YOU SURE YOU WANT TO EXIT THE SYSTEM"
1730 GOSUB 1630:IF R$="Y" THEN 1750
1740 IF R$="N" THEN 10
1750 SYSTEM
1760 OUT BASE% + 0.255:OUT BASE% + 2.255:GOTO 150
```

What is claimed is:

1. A combustion chamber cleaning machine for cleaning each of a plurality of combustion chambers, said machine comprising:

a frame;

a major, generally planar turntable rotatably supported by the frame;

a plurality of minor turntables rotatably connected to said major turntable, said combustion chambers being carried by said minor turntables;

means for rotating the minor turntables;

means for directing material at the combustion chambers; and indexing means for intermittently rotating the major turntable, said indexing means comprising an indexing gear operably connected to said major turntable, said gear having an axis of rotation coaxial with the axis of rotation of said major turntable, and an operator means for incrementally turning and locking said gear, said operator means pivotally coupled to said frame and comprising a reciprocating ram having a first and second end, the first end received in means for extending and retracting the ram and the second end carrying rounded tip means for contacting said indexing gear, said indexing gear having rounded lobes complimenting said rounded tip means, whereby each of the chambers is revolved successively into proximity with said means for directing material and alignment of a minor turntable with said means for rotating the minor turntables is achieved, said rounded lobes of said indexing gear and said rounded tip means comprising complimentary engagement means for locking the indexing gear in a fixed position when a minor turntable is aligned with said means for rotating the minor turntables.

2. The machine according to claim 1, wherein said means for rotating said minor turntables comprises a motor, said motor being selectively and operably engageable with successive minor turntables brought into alignment with the motor as the major turntable is rotatably indexed.

3. The machine according to claim 2, wherein said motor is pneumatic.

4. The machine according to claim 3, wherein said machine function are controlled by a computer.

5. An indexing machine for successively carrying each of a plurality of workpieces to and from a work station comprising:

a frame;

a generally horizontal main disk rotatably supported by said frame and having a generally vertical axis of rotation;

a plurality of individual minor disks, said minor disks rotatably connected to said main disk adjacent to and equally spaced about the periphery of the main disk, each of said minor disks for supporting a workpiece and being in a plane generally parallel and adjacent to the plane in which the main disk lies;

drive means for rotating an individual minor disk and the workpiece supported thereby;

means for spraying material onto the workpiece at said work station, said spraying means extensible relative to said workpiece;

indexing means for indexing the main disk whereby each workpiece is brought successively to said work station and alignment of a minor turntable with means for rotating the minor turntables is achieved; and means for locking said main disk when a minor turntable is indexed into alignment with said means for rotating the minor turntables.

6. The machine according to claim 5, wherein said indexing means comprises:

a lobed gear having rounded lobes, said gear rotatably supported by said frame in a plane parallel to a plane containing the main disk, said gear having an axis of rotation coaxial with the axis of rotation of the main disk and operably coupled to the main disk;

a locking block, coplanar and in close fixed proximity with respect to said gear; and gear drive means for turning said gear, said gear drive means including a cylinder and ram assembly pivotably coupled to said frame and generally coplanar with said lobed gear, said ram being extensible and retractable with respect to said gear and having an asymmetrically rounded gear contacting end complimentary to said rounded lobes of said gear, such that when fully extended, the gear contacting end contacts the gear and the locking block.

7. The machine according to claim 6, wherein said gear drive means pivots in a short arc between a pre-indexing position and an indexed position.

8. The machine according to claim 5, wherein said workpieces depend downwardly from said minor disks, are generally cylindrical, having open ends, and said spraying material is applied onto the interior wall of a workpiece by an extensible means for delivering said material at high pressure.

9. A combustion chamber cleaning machine for cleaning each of a plurality of combustion chambers, said machine comprising:

a frame;

a major, generally planar turntable rotatably supported by the frame;

a plurality of minor turntables rotatably connected to said major turntable, said combustion chambers being carried by said minor turntables, said minor turntables being generally solid, flat disks substantially coplanar with said major turntable, said chambers depending from said disks;

means for rotating the minor turntables;

means for directing material at the combustion chambers; and indexing means for intermittently rotating the major turntable, said indexing means comprising an indexing gear operably connected to said major turntable and an operator means for incrementally turning said gear, said operator means pivotally coupled to said frame, whereby each of the chambers is revolved successively into proximity with said means for directing material and whereby alignment of a minor turntable with said means for rotating the minor turntables is achieved, said minor turntables being coupled to said means for rotating minor turntables only when said major turntable is not rotating.

10. A combustion chamber cleaning machine for cleaning each of a plurality of jet engine combustion chambers, said machine comprising:

a frame;

a major, generally planar turntable rotatably supported by the frame;

a plurality of minor turntables rotatably connected to said major turntable, said combustion chambers being carried by said minor turntables;

means for rotating the minor turntables, said means operably mounted on said frame and comprising a motor, said motor being selectively and operably engageable with successive minor turntables brought into alignment with the motor as the major turntable is rotated;

means for directing material at the combustion chambers;

indexing means for intermittent rotation of the major turntable, said indexing means comprising:

an indexing gear with rounded lobes, said gear rotatably supported by said frame in a plane parallel to the plane of the major turntable, having an axis of rotation coaxial with the axis of rotation of the major turntable, and operably connected to the major turntable;

a locking block, coplanar with and in close fixed proximity to said gear; and a gear driving operator means for incrementally turning said gear, said operator means being generally coplanar with the gear, and pivotally coupled to said frame for pivotal movement through a short arc between a pre-indexing position and an indexed position, and comprising a reciprocating ram having a first end and a second end, said first end received in a cylinder means for extending and retracting the ram and said second end carrying a gear contacting, rounded tip means for contacting the indexing gear such that, when fully extended, said rounded tip means contacts both the gear and the locking block, said tip means and the lobes of the gear having complimentary rounded mating surfaces; and a cabinet with an access door, said cabinet supported by said frame and enclosing said frame, major turntable, minor turntables, means for rotating the minor turntables, means for directing material, indexing means and combustion chambers to be cleaned, whereby, within said cabinet, each of said combustion chambers is revolved successively and releasably locked into proximity with said means for directing material.

* * * * *